US010852051B2

(12) United States Patent
Matthews

(10) Patent No.: US 10,852,051 B2
(45) Date of Patent: Dec. 1, 2020

(54) METHOD OF FORMING A HEAT SWITCH

(71) Applicant: OXFORD INSTRUMENTS NANOTECHNOLOGY TOOLS LIMITED, Abingdon (GB)

(72) Inventor: Anthony Matthews, Didcot (GB)

(73) Assignee: Oxford Instruments Nanotechnology Tools Limited, Abingdon (GB)

( * ) Notice: Subject to any disclaimer, the term of this patent is extended or adjusted under 35 U.S.C. 154(b) by 119 days.

(21) Appl. No.: 16/310,439

(22) PCT Filed: Jun. 5, 2017

(86) PCT No.: PCT/GB2017/051611
§ 371 (c)(1),
(2) Date: Dec. 16, 2018

(87) PCT Pub. No.: WO2017/216519
PCT Pub. Date: Dec. 21, 2017

(65) Prior Publication Data

US 2019/0338996 A1 Nov. 7, 2019

(30) Foreign Application Priority Data

Jun. 15, 2016 (GB) ..... 1610379.8

(51) Int. Cl.
*F25D 19/00* (2006.01)
*F25B 21/00* (2006.01)
*F28F 13/00* (2006.01)

(52) U.S. Cl.
CPC ..... *F25D 19/006* (2013.01); *F25B 21/00* (2013.01); *F28F 13/00* (2013.01); *F28F 2013/008* (2013.01)

(58) Field of Classification Search
CPC ..... F25D 19/006; F25B 21/00; F25B 9/14; F25B 9/12; F28F 13/00; F28F 2013/008; F28D 15/02
See application file for complete search history.

(56) References Cited

PUBLICATIONS

J Franco et al, Applied Thermal Engineering, vol. 70, No. 1,May 9, 2014 (May 9, 2014), pp. 115-112.*

* cited by examiner

*Primary Examiner* — Elizabeth J Martin
(74) *Attorney, Agent, or Firm* — Brooks, Cameron & Huebsch, PLLC

(57) ABSTRACT

A method for forming a gas gap heat switch is provided comprising the following steps: (a) providing first and second conductors, and first and second connecting members, wherein the connecting members each have a thermal conductivity at least five times smaller than that of the conductors when at a temperature of 100K; (b) fusing the first conductor to the first connecting member and the second conductor to the second connecting member; (c) aligning the conductors such that the first and second conductors extend along a common major axis; (d) bringing proximal ends of the aligned conductors into contact with each other when said conductors are at a first temperature; and (e) joining the first connecting member to the second connecting member so as to form a chamber around at least the proximal ends of the conductors.

20 Claims, 4 Drawing Sheets

METHOD OF FORMING A HEAT SWITCH

CROSS-REFERENCE TO RELATED APPLICATIONS

This application is a PCT national phase filing under 35 U.S.C. 371 and claims priority to international patent application PCT/GB2017/051611, filed Jun. 5, 2017, which itself claims priority to British patent application number GB1610379.8, filed Jun. 15, 2016, both of which are entitled, "Method of Forming a Heat Switch." The entire texts of the above-referenced disclosures are specifically incorporated herein by reference without disclaimer.

FIELD OF THE INVENTION

The present invention relates to the field of cryogenics and, in particular, to a method for forming a gas gap heat switch.

BACKGROUND TO THE INVENTION

Gas gap heat switches (or "thermal switches") are known in the field of cryogenics and are particularly useful in 'cryogen-free' systems, where the cooling is provided by closed cycle mechanical coolers rather than liquefied gases. These switches may be controlled to transfer or isolate a thermal load from one end of the switch to the other. In general they comprise at least two conductors which are separated from each other within a chamber into which a gas can be introduced. When the switch is closed, the gas inside the chamber facilitates heat transfer between the conductors by conduction. The switch is opened by evacuating the gas from the chamber so that this heat transfer path is no longer available.

The conductors typically take the form of interleaving or 'Interdigitated' members, for example in the form of fins, which are arranged to provide a large heat transfer surface between the conductors. A gap must be present between the conductors of the switch in order to allow the thermal connection to be broken when the switch is opened. Nonetheless, the size of this gap should be kept to a minimum in order to achieve reliable heat transfer when the switch is closed. The performance of the switch is parameterised by the ratio of the effective heat exchange surface area divided by the separation (or gap) between the conductors (A/L). It is relatively difficult to manufacture a high performance switch using the interdigitated design, particularly when the switch is miniaturised.

Simpler designs for gas gap heat switches have previously been proposed in which, instead of the interdigitated arrangement, the conductors are collinearly arranged. These switches are generally avoided however, particularly for low-temperature applications, due to their poor heat transfer properties in the closed state, which is limited by the gap size.

It is desirable to provide a simple gas gap heat switch which can be reliably and easily constructed, and which delivers excellent performance at low temperatures.

SUMMARY OF THE INVENTION

In a first aspect of the invention there is provided a method for forming a gas gap heat switch comprising the following steps:

(a) providing first and second conductors, and first and second connecting members, wherein the connecting members each have a thermal conductivity at least five times smaller than that of the conductors when at a temperature of 100K;

(b) fusing the first conductor to the first connecting member and the second conductor to the second connecting member;

(c) aligning the conductors such that the first and second conductors extend along a common major axis;

(d) bringing proximal ends of the aligned conductors into contact with each other when said conductors are at a first temperature; and (e) joining the first connecting member to the second connecting member so as to form a chamber around at least the proximal ends of the conductors;

wherein the connecting members forming the chamber each have a coefficient of thermal expansion that is less than that of the conductors such that, when the conductors are cooled to a second temperature which is below the first temperature, the length of the conductors along the major axis decreases with respect to the length of the chamber along the major axis so as to form a gap between the proximal ends of the conductors; and wherein the switch is arranged to selectively provide a thermally conductive gas into the chamber when in use to cause operation of the switch.

Unlike the interdigitated prior art design, the conductors are aligned (for example collinearly arranged) so as to extend along a common major axis. The thermally conductive gas therefore transfers heat between the opposing proximal ends of the conductors only, rather than along the entire length of each conductor. This reduction in the effective heat transfer surface is compensated for however by a smaller separation between the opposing conductors than has previously been realisable in reliable heat switches. Effective heat transfer across the switch can therefore be maintained, whilst ensuring a reliable and robust separable thermal connection is provided.

A thermal contraction gas gap heat switch is herein proposed wherein the separation between opposing collinearly arranged conductors is controllable depending on the temperature of the conductors. Advantageously, this switch may be assembled at room temperature (which is the first temperature in this case). Once assembled, the switch may then be cooled such that the difference in the thermal expansion coefficients between the sleeve and the conductors enables the conductors to contract relative to the sleeve. A small gap is thus created between the opposing ends of the conductors. Heat transfer occurs in this gap primarily by conduction using a thermally conductive gas.

Steps (a) to (e) are typically performed in order, however it is possible that step (c) is performed before step (b). In any case, step (b) is performed before steps (d) and (e). Step (e) is typically performed when the proximal ends of the aligned conductors are in contact with each other, that is, after step (d).

Step (e) relates to a process of joining two initially separate connecting members together. In accordance with one approach, step (e) comprises fusing the first connecting member to the second connecting member. Thus these components may be joined together directly. The first or second connecting member preferably may include a sleeve portion configured to envelope at least the proximal ends of the first and second conductors. The first and second connecting members together create the chamber walls which define the chamber in this case.

Fusing the connecting members together will typically input heat to the switch. It is advantageous to ensure this heat is not conducted throughout the length of the conductors, hence highly localised heating processes, such as electron-beam welding are preferred for these joints. Preferably therefore fusing the first connecting member to the second connecting member is performed using electron-beam welding. This may enable the conductors to remain at approximately the first temperature during step (e), for example to within an average of approximately 20 K.

In an alternative approach, step (e) comprises fusing each of the first and second connecting members to a sleeve provided between said connecting members; wherein the thermal conductivity of the sleeve is at least five times smaller than that of the conductors when at a temperature of 100K; and wherein the coefficient of thermal expansion of the sleeve is less than that of the conductors such that, when the conductors are cooled to the second temperature, the length of the conductors along the major axis decreases so as to form said gap. An intermediate sleeve may therefore be provided so as to form part of the chamber. The first and second connecting members may therefore be joined together indirectly by step (e). This method typically requires an additional joint to be made (preferably also using electron-beam welding) in order to fuse each of the connecting members to the sleeve, however it may allow for easier assembly in some instances, depending on the shape and size of the heat switch and any accompanying apparatus. The first and second connecting members preferably form first and second flanges respectively. These flanges may be arranged in use so as to close the open ends of the sleeve. The first and second connecting members and the sleeve may together form chamber walls therefore which define the chamber in this embodiment, with the flanges acting as respective opposing ends of the chamber. The sleeve itself may be unitary or may be formed from several parts.

It is advantageous to ensure that a significant heat exchange path is not established along the sleeve as this would bypass the conductors and the gap, effectively preventing the switch from being opened. The sleeve (either as a separate member or a portion of a connecting member) therefore preferably has a thermal conductivity that is at least 10 times smaller than that of the conductors when at a temperature of 100 K. The thermal conductivity of different materials tends to diverge at lower temperatures and so, the sleeve may have a thermal conductivity that is at least 1000 times smaller than that of the conductors when at a temperature of 10 K. For similar reasons, the first and second connecting members preferably have a thermal conductivity at least 10 times smaller than that of the conductors when at a temperature of 100 K. Preferably still, the first and second connecting members have a thermal conductivity at least 1000 times smaller than that of the conductors when at a temperature of 10 K.

The conductors are preferably copper, or copper-based (including oxygen-free copper) due to their high thermal conductivity and thermal expansion properties. The connecting members are preferably stainless steel since this exhibits the desired thermal conductivity and thermal expansion properties, relative to copper. Stainless steel is also desired as it exhibits excellent weldability. The sleeve is also preferably made of stainless steel for similar reasons.

The method preferably further comprises step (f) of cooling each of the conductors to a respective temperature that is below the second temperature such that the length of the conductors along the major axis decreases so as to form the gap between the proximal ends of the conductors. This step is typically performed by the end user of the gas gap heat switch, once it has been installed to an operational location and, for example, coupled to a mechanical refrigerator for cooling. Cooling may be applied directly to one of the conductors by an external member during this stage, with the switch being maintained in its closed state to enable heat transfer to occur from the other conductor. Alternatively both conductors may be cooled directly during this stage. Most typically a temperature differential is maintained across the switch so that the two conductors are at different temperatures, each below the second temperature.

It is desirable to ensure that the path length for the gas to travel between the opposing conductors is kept to a minimum. It is advantageous therefore to achieve a uniform gap size between the opposing surfaces of the conductors.

Step (a) therefore may further comprise machining the first and second conductors so as to form a flat engagement surface on each of the conductors, and step (d) may comprise bringing said engagement surfaces into contact with each other. Curved engagement surfaces may also in theory be used so as to achieve a uniform gap size from all points on an engagement surface of the abutting conductors, however flat surfaces are preferable as they can in general be machined to a higher degree of accuracy. Most preferably said engagement surfaces therefore extend in a plane having a normal that extends along the major axis of the respective conductor.

The gap may be thought of as the closest approach between all opposing surfaces of the first and second conductors. For conductors having opposing (engagement) surfaces that are orthogonal to the major axis, this gap will be measured along the major axis, however in other cases the gap may be measured along a different direction, depending on the minimum separation between the two conductors.

The gap is formed by thermal contraction of the conductors along their major axes. The first and second conductors are therefore preferably elongate to ensure that an appreciable contraction occurs such that the two conductors do not directly contact each other at the second temperature.

Most typically, the gap is less than 0.05% the sum of the dimensions of the conductors along the major axis between a respective point of joining of the first conductors with the first connecting member and the second conductor with the second connecting member. As the conductors and the connecting members may have multiple points of joining, or an extensive join region, the relevant point of joining is nearest to the proximal end of the respective conductor. It is this point which provides the zero mutual strain position between the joined components with respect to which the relative differential thermal contraction occurs. Conductors having dimensions along the major axis of the order of several centimetres can then produce gap sizes of the order of several micrometres, thus allowing excellent heat transfer between the conductors by the thermally conductive gas.

Step (b) is preferably performed by a brazing process. Such a process produces robust joints, which is advantageous during thermal cycling. This process also may produce a joint which is resistant to gas leaks and so will contribute to sealing the chamber. Vacuum brazing in particular is preferred since this produces extremely clean, flux-free braze joints of high integrity and strength. The heat input (and associated thermal expansion of the conductors) during step (b) causes no problems because the conductors have not yet been brought into contact—step (d).

The switch is preferably configured to evacuate the chamber when in use in order to substantially thermally isolate the opposing distal ends of the conductors. This step effectively 'opens' the switch so that negligible heat transfer occurs between the two conductors of the switch. A gas pump or other evacuating means including an adsorption pump and a getter may be provided to assist with this process. Optionally the getter and/or adsorption pump may be integrated into the switch so as to provide a sealed unit.

Most typically the first temperature is between 280 and 310 K. The switch may therefore be advantageously assembled approximately at room temperature. The gap between the two aligned conductors occurs at a lower temperature however, which is the second temperature. This second temperature may be thought of as an operational temperature of the heat switch below which the switch can be opened and closed. The switch could still be useful at temperatures above the second temperature in forming a heat transfer path along mutually contacting conductors, for example for aiding the cool down of a system to a lower temperature. The second temperature may include any temperature below 100 K, but is most typically between 5 and 20 K. Since the purpose of the switch is to selectively thermally isolate one end of the switch from the other, the ends of the switches when in an "open" state may be each at different temperatures, each of which is below the second temperature.

In a second aspect of the invention there is provided a gas gap heat switch comprising:

- first and second conductors aligned along a common major axis, wherein the first and second conductors each have a length of at least 5 cm along the major axis;
- first connecting member and second connecting member forming a chamber around at least the proximal ends of the conductors, wherein the connecting members have a thermal conductivity at least five times smaller than that of the conductors when at a temperature of 100K;
- wherein the connecting members each have a coefficient of thermal expansion that is less than that of the conductors;
- wherein the proximal end of the first conductor is separated from the proximal end of second conductor by a gap of less than 50 μm; and
- wherein the switch is arranged to selectively provide a thermally conductive gas into the chamber when in use to cause operation of the switch.

Preferably the gap is less than 30 micrometres as this enables even better heat transfer between the opposing conductors by the thermally conductive gas.

The gas gap heat switch of the second aspect preferably further comprises a sleeve provided between said connecting members and arranged to extend at least over the proximal ends of the conductors;

- wherein each of the first and second connecting members is fused to the sleeve;
- wherein the sleeve has a thermal conductivity at least five times smaller than that of the conductors when at a temperature of 100K;
- wherein the sleeve has a coefficient of thermal expansion that is less than that of the conductors; and
- wherein the sleeve and the connecting members form the chamber In a third aspect of the invention there is provided a cryogenic system comprising:

- a gas gap heat switch according to the second aspect;
- a mechanical refrigerator coupled to the first conductor; and
- a target apparatus coupled to the second conductor.

In some embodiments the third aspect may provide faster cool down times for the target apparatus than is achievable using some prior art gas gap heat switches. The target apparatus may be any item to be cooled, including in theory an additional stage of a mechanical refrigerator.

The second and third aspects of the invention may share similar features to the first aspect, with the same advantages applying by analogy.

BRIEF DESCRIPTION OF THE FIGS

Examples of the invention will now be discussed with reference to the accompanying drawings, in which.

DETAILED DESCRIPTION

An embodiment of a method for forming a thermal contraction gas gap heat switch 10, as well as an embodiment of this switch 10, will be discussed with reference to the flow chart of FIG. 5 as well as the accompanying drawings of FIGS. 1 to 3.

Figure 5:
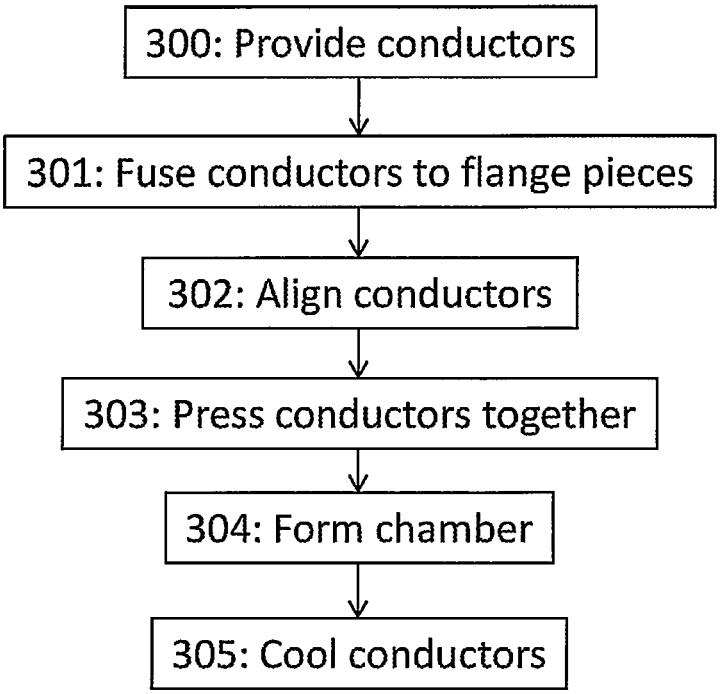
FIG. 5 is a flow chart illustrating a method according to an embodiment.

First and second conductors 2, 3 are provided at step 300 of FIG. 5. A sectional view of a first conductor 2 and a first connecting member in the form of a first flange 4 is provided in FIG. 1. The first conductor 2 is elongate and substantially cylindrical. The first flange 4 comprises a central bore with a diameter of about 1 cm, which engages with a first end portion 11 of the first conductor 2. The first end portion 11 has a diameter of 1 cm along its length, whereas the remainder of the conductor 2 has a larger constant diameter of 2 cm along its length, such that the first flange 4 is fitted onto and around the first end portion 11 only as a collar. The first end portion 11 comprises a central bore 18 for enabling a physical connection of the conductor 2, such as to a mechanical refrigerator or target apparatus, with which heat is to be transferred. This physical connection may in part be achieved by fastening a plurality of bolts that extend through the first flange 4 into a pitch circle of bolt holes 9 provided in the first end portion 11.

A similar second conductor 3 (not shown in FIG. 1) is also provided which engages with a second connecting member in the form of a second flange 5 in a similar manner. Each conductor 2, 3 has a length of approximately 5 cm along its major axis. In alternative embodiments the conductors 2, 3 may have different lengths along their respective major axes.

The first and second conductors 2, 3 are fused to the first and second flanges 4, 5 respectively at step 301. Preferably, the first flange 4 is vacuum brazed onto the first end portion 11 of the conductor 2 in order to achieve a reliable permanent connection that is robust to thermal cycling. Separately, this process is then repeated for the second conductor 3 using the second flange 5.

In order to enable heat transfer along the switch, the first and second conductors 2, 3 are each formed from a highly thermally conductive material. As the switch is intended to be used at low temperatures, including those below 100 K, this means that the conductors 2, 3 should be highly thermally conductive at such low temperatures. The first and second conductors 2, 3 are each typically formed from the same material to ensure similar thermal conduction and expansion properties. Most typically this material is copper, preferably oxygen-free copper; however in principle silver could also be used. Ideally the conductors would have a thermal conductivity above 5000 W/m K at a temperature of 20 K.

The first and second conductors 2, 3 are aligned (in this case 'collinearly arranged') at step 302 so as to extend along a common major (or 'longitudinal') axis, such that the first end portions 11, 12 are arranged at opposing distal ends of the conductors 2, 3, with the flanges are being provided at these ends. The brazing process will input heat to the conductors 2, 3, which may cause the conductors 2, 3 to expand. The operator should wait for this heat to dissipate from the conductors 2, 3 before commencing step 303.

An annular sleeve 6 is provided which has an inner diameter that is fractionally larger than the diameter of the conductors 2, 3. The length of the sleeve along its major axis is shorter than the switch length, which is formed by the sum of the dimensions of the conductors 2, 3 along their major axis. In this case the switch length is around 10 cm and the sleeve length is around 9 cm along the major axis.

At step 303 of FIG. 5 the conductors 2, 3 are then brought or 'pressed' together inside the sleeve 6 at a first temperature, which is at room temperature (or between 290 to 300 K), until the ends 13, 14 of the conductors 2, 3 that are proximal to each other are in mutual contact at the first temperature. The respective major axes of the conductors 2, 3 and the sleeve 6 are thus aligned along a common major axis at this stage. The sleeve 6 is preferably unitary (i.e. formed of one piece) however alternatively it may consist of several pieces. In an alternative assembly process the conductors 2, 3 are first collinearly arranged and then the sleeve 6 is slid over one of the connecting members, or assembled around the conductors 2, 3, so as to envelope the conductors 2, 3.

The first and second conductors 2, 3 are arranged such that no gaps exist between the abutting faces of the conductors 2, 3 at the first temperature. In this embodiment this is achieved by ensuring that the conductors 2, 3 have flat faces (or "engagement surfaces") at the proximal ends 13, 14, perpendicular to the major axis of the conductors 2, 3, which abut together. The uniformity and accuracy of this flatness may be achieved using machining, prior to assembly at step 303 (before or after step 301). Other shaped surfaces are also possible, provided that the proximal ends 13, 14 of the conductors 2, 3 mate with one another so as to leave no macroscopic gap when pressed together. The engagement surfaces preferably have the same surface area and are arranged such that the radial surface of the conductors 2, 3 are flush at the proximal ends 13, 14.

The sleeve 6 and the flanges 4, 5 form a housing which defines a chamber 16 in the region between the first and second flanges 4, 5. In particular, the inner diameter of the sleeve 6 is larger than the outer diameter of the conductors 2, 3, for example by 1 mm, so that an annular chamber 16 is formed along the length of the conductors 2, 3.

At step 304, the sleeve 6 is fused onto the first and second flanges 4, 5 so as to form a sealed chamber 16 and thereby form the switch 10. The sleeve 6 is joined to the flanges 4, 5 at respective ends of the sleeve 6 using a localised heating process, such as electron-beam welding. Advantageously, there is no significant heat input to the conductors 2, 3 that would cause them to expand during this process.

The flanges 4, 5 and the sleeve 6 are formed from a material which is thermally insulating at low temperatures, relative to the conductors 2, 3, so that they do not form part of the heat transfer path between opposing distal end portions 11, 12 of the switch 10. In particular the thermal conductivity of the conductors 2, 3 should be at least five times greater than that of the flanges 4, 5 and the sleeve 6 at a temperature of 100 K. Thermal conductivity tends to diverge between different materials at lower temperatures and so this difference may be even greater, for example by a factor of 1000 at a temperature of 10 K. A suitable candidate material for the flanges 4, 5 and the sleeve 6 is stainless steel, which has the added benefit of providing good weldability. Most preferably the flanges 4, 5 and the sleeve 6 are each formed from the same material so as to exhibit similar thermal conductivity and expansion/contraction properties.

Importantly, the sleeve 6 is fused to the stainless steel flanges 4, 5 and not directly to the copper conductors 2, 3. The flanges 4, 5 (which have a lower thermal conductivity than the conductors 2, 3) act as thermal barriers which reduce the amount of heat which is conducted along the length of the conductors 2, 3 during the fusion process. Any heating is therefore localised and elongation of the conductors 2, 3 as a result of thermal expansion during the fusion process of step 304 is substantially avoided. The contact between the conductors 2, 3 is therefore achieved at the first temperature, and not a temperature which has been elevated due to the heat input from the fusing process. The advantages of this will later become evident.

At step 305 the switch 10 is installed into an operational location and the first and second conductors 2, 3 are cooled. For example a cryogenic refrigerator may be connected to either or both of the conductors 2, 3 at the respective distal end portions 11, 12 of the heat switch 10 using the bores 18 (and optionally further connecting bolts). The chamber 16 may be filled with a thermally conductive gas, typically helium at a pressure of 1 bar absolute, at this stage. For low temperature applications of around 10 mK helium-3 is preferred as it has a much lower super-fluid transition temperature than helium-4 and so is less likely to cause an unwanted thermal short. Either gas could be used however.

The heat switch 10 is arranged to selectively provide a thermally conductive gas, into the chamber 16 when in use to enable controllable heat transfer across the switch 10. This may be achieved by providing one or more tubes that extend from a gas source into the sleeve 6, or either of the flanges 4, 5 and terminate in the chamber 16 so as to provide a flow of thermally conductive gas to/from the chamber 16. Alternatively these tubes may extend through either of the conductors 2, 3, terminating at the distal end 13, 14 of the respective conductor. In the embodiment shown by FIG. 2 the gas delivery tube 15 extends through the second flange 5 and terminates inside the chamber 16. The gas source may optionally take the form of a getter or an adsorption pump to assist in evacuating the gas when desired so as to open the switch. Optionally the getter or adsorption pump may be integrated into the switch.

The coefficient of thermal expansion of each of the sleeve 6 and the flanges 4, 5 is less than that of the conductors 2, 3 such that, when the conductors 2, 3 are cooled to a second temperature which is below the first temperature, the length of the conductors 2, 3 along the major axis decreases so as to form a gap 8 (shown by FIG. 3, not to scale) between the proximal ends of the conductors 2, 3. This separation occurs as a result of the difference between the thermal expansion properties of the sleeve 6 and the conductors 2, 3, as well as the physical arrangement of the components of the switch 10. In particular, the first and second conductors 2, 3 are connected to the sleeve 6 at their distal ends 11, 12 only, by the flanges 4, 5. The conductors 2, 3 are therefore free to contract along the major axis, without exerting a force on the sleeve 6 which separates them. The sleeve 6 (and to a lesser extent the flanges 4, 5) may also contract as the temperature of the switch 10 is cooled to the second temperature, however this change will not be as appreciable as the reduction in length of the conductors 2, 3.

The second temperature can be thought of as the maximum temperature of one or each of the two conductors to ensure an "open" condition of the switch is achievable. In practice it can be thought of as an operational temperature and is typically significantly below the first temperature, for example it may include any temperature below 100 K. Of course, the distal end portions 11, 12 may be at different temperatures (each below the second temperature), and indeed this will typically be the case during operation of the heat switch 10. At a temperature of 10 K the stainless steel shell 6 will contract by about 0.29%, whereas the copper conductors 2, 3 will contract by about 0.31%. In the present embodiment this relative difference in contraction will produce a gap 8 of about 20 μm between the opposing faces of the conductors 2, 3 (assuming a switch length, as previously defined, of around 10 cm). The size of this gap 8 depends on the difference in the thermal expansion coefficients between the conductors 2, 3 and the sleeve 6, the length of the conductors 2, 3 along the major axis, and the temperature to which the conductors 2, 3 are cooled. Typically the gap is below 0.05% of the switch length.

The above method of constructing a gas gap heat switch 10, together with the switch design, has the notable advantage that the distal ends of the conductors 2, 3 are physically connected at step 304, when the conductors 2, 3 are approximately at room temperature. If conversely the sleeve 6 were welded directly to the distal ends 13, 14 of the conductors 2, 3, whilst they are in mutual contact this process would input heat to the system which would be conducted through the conductors 2, 3 and cause them to expand. Contact between the conductors 2, 3 would instead then occur at a higher temperature. This would ultimately mean that a much larger gap 8 would be created when the switch 10 was cooled to the second temperature, thereby leading to poorer heat transfer performance.

In some embodiments an even smaller gap 8 may be achieved by pressing the conductors 2, 3 together with an increased force at step 303, and attaching the sleeve 6 potentially using braces such that the heat switch 10 is pre-stressed, or pre-tensioned, causing a slight negative strain in the conductors 2, 3 which decreases to zero when the conductors 2, 3 partially thermally contract at step 305.

Figure 4:
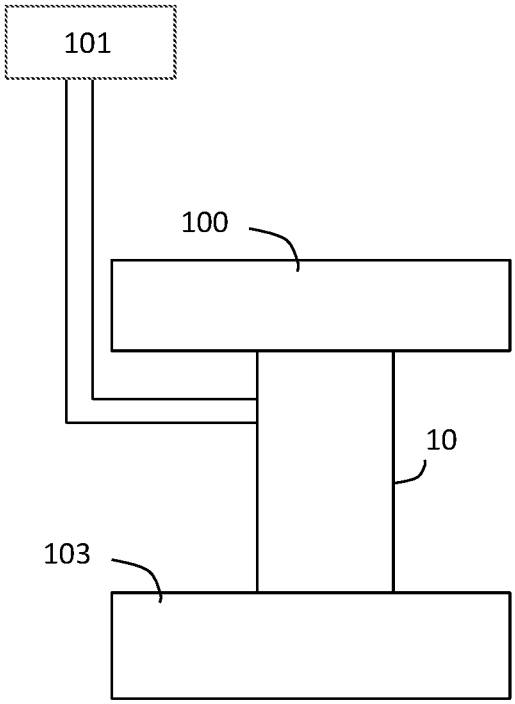
FIG. 4 is a schematic illustration of a cryogenic system according to an embodiment.

An example of an assembly in which the heat switch 10 may find particular benefit will now be described with reference to FIG. 4. A mechanical refrigerator in the form of pulse tube refrigerator is generally illustrated at 100. This may be used to cool various types of target apparatus, including parts of a magnet system, experimental sensors or other apparatus for experimental use, or for example to pre-cool various stages of a dilution refrigerator. Such a target apparatus 103 is illustrated as being attached to the PTR 100 via the heat switch 10. Thermally conductive plates, may be provided between the heat switch 10 and PTR 100 or the target apparatus 103 to facilitate thermal connection. A gas source 101 is also schematically illustrated, which is arranged to provide a controllable flow of thermally conductive gas to and from the heat switch 10 so as to cause operation of the switch 10, but this could also be internal to the construction of the switch 10.

In this case the second stage of a PTR 100 is connected to a first conductor 2 of the heat switch at a first end of the switch 10, whereas the target apparatus 103 is connected to the second conductor 3 at the second end of the switch 10. The conductor 2 is thus cooled to a temperature which is below that of the second conductor 3 and a heat flow path is set up across the switch 10 when the switch is closed.

When each of the conductors 2, 3 is cooled to a respective temperature that is below 100 K, a gap 8 is formed between the first and second conductors 2, 3. When the heat switch 10 is in its closed state, a thermally conductive gas is present within the chamber 16 formed by the sleeve 6 and the conductors 2, 3. Heat is then transferred across the switch 10, between the target apparatus 103 and the PTR 100. This occurs firstly by conduction along each of the conductors 2, 3, and secondly by conduction using the thermally conductive gas in the region of the gap 8. Negligible heat transfer occurs along the sleeve 6, due to the low thermal conductivity of the sleeve material. The heat switch 10 provides improved thermal conductivity in this closed state over some prior art designs as the path length which the gas has to travel in order to convey heat between the conductors 2, 3 is smaller.

The heat switch 10 may be opened so as to thermally isolate the PTR 100 from the target apparatus 103 by evacuating the heat switch 10 using the controllable gas source 101. This removes the potential for heat transfer by gas conduction between the first and second conductors 2, 3 of the heat switch 10.

A small amount of heat transfer may still occur across the sleeve 6 when the switch 10 is open. The amount of this heat leak depends at least in part on the properties of the sleeve 6, as well as the temperature of the bodies 100, 103 which are connected to the opposing ends of the switch 10. For a stainless steel sleeve 6 of 20 mm in diameter with a 1 mm wall thickness and a length of 20 cm along the major axis, one may expect around 0.5 mW to be conducted between a first body 100 at a temperature of 4 K and a second body 103 at a temperature of 1 K. The value of the heat leak scales inversely with the length of the sleeve.

Figure 6:
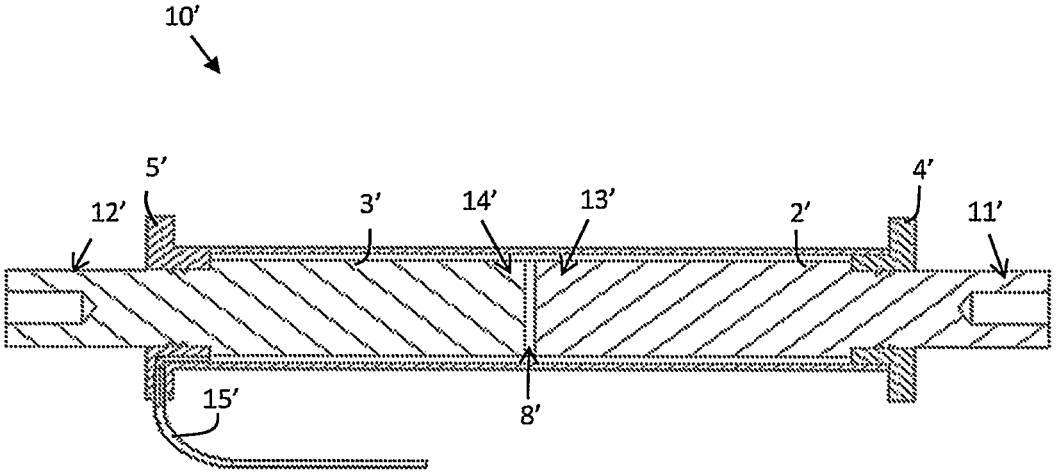
FIG. 6 is a sectional view of an embodiment of a gas gap heat switch.

An alternative embodiment of a gas gap heat switch 10' is illustrated in FIG. 6, wherein primed reference numerals are provided to indicate equivalent features to the heat switch 10 earlier discussed. The heat switch 10' is similar to the earlier embodiment except for two key differences:

Firstly, the sum of the length of the conductors 2', 3' is significantly greater than the combined length of the flanges and their intermediate sleeve, along the major axis. The end portions 11', 12' therefore extend significantly beyond connecting members 4', 5' along the major axis in a direction away from the gap 8'. The portions of the conductors 2', 3' which extend from the connecting members 4', 5' to the respective distal ends of the conductors do not affect the gap size, but can be used to achieve a better thermal connection with a connecting apparatus due to the increased surface area of the conductors that is exposed. For switches of a given length (as measured along the major axis and between the distal ends of the conductors) a smaller final gap size can be achieved by arranging the intermediate sleeve and the connecting flanges so as to extend across a smaller portion of the conductors (as shown in FIG. 6), than if they extend instead across approximately the full length of the switch (as shown in FIGS. 2 and 3). This is a result of the reduced length of the conductors which is free to contract when cooled towards the respective connecting member.

Secondly, the sleeve and the second connecting member 5' are unitary. In other words, the second connecting member 5' forms both the sleeve 6 and the second flange 5 of the earlier embodiment. The second connecting member 5' may thus be constructed as a single stainless steel component. Only one joint therefore needs to then be made at step 304 in order to form the chamber. This joint is made directly between the first and second connecting members 4', 5', using electron-beam welding. In the illustrated embodiment the first connecting member 4' behaves as a flange or collar only, however in an alternative embodiment each of the connecting members 4', 5' may have an extending sleeve portion such that the sleeve and chamber as a whole are formed by the fusing the two connecting members 4', 5' together.

Figure 1:
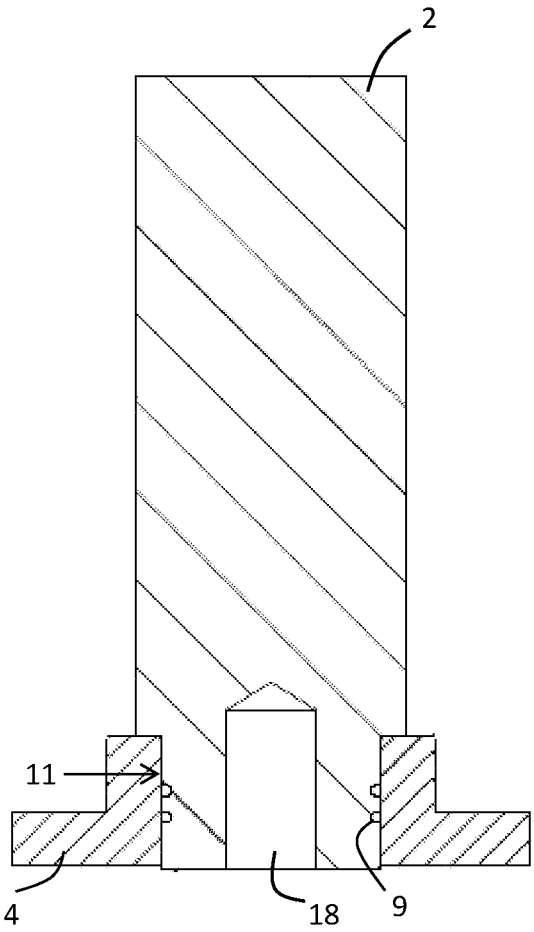
FIG. 1 is a sectional view of a first conductor and a first connecting member.
Figure 2:
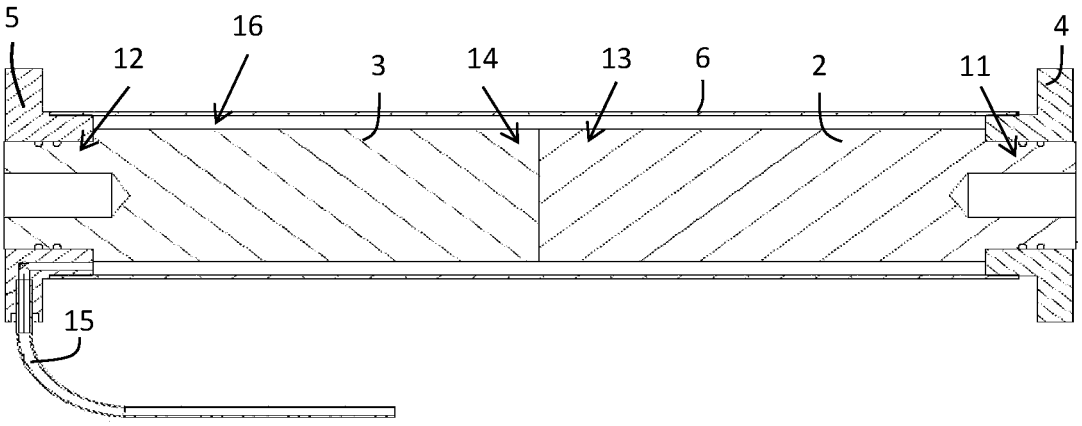
FIG. 2 is a sectional view of first and second conductors arranged inside a sleeve.
Figure 3:
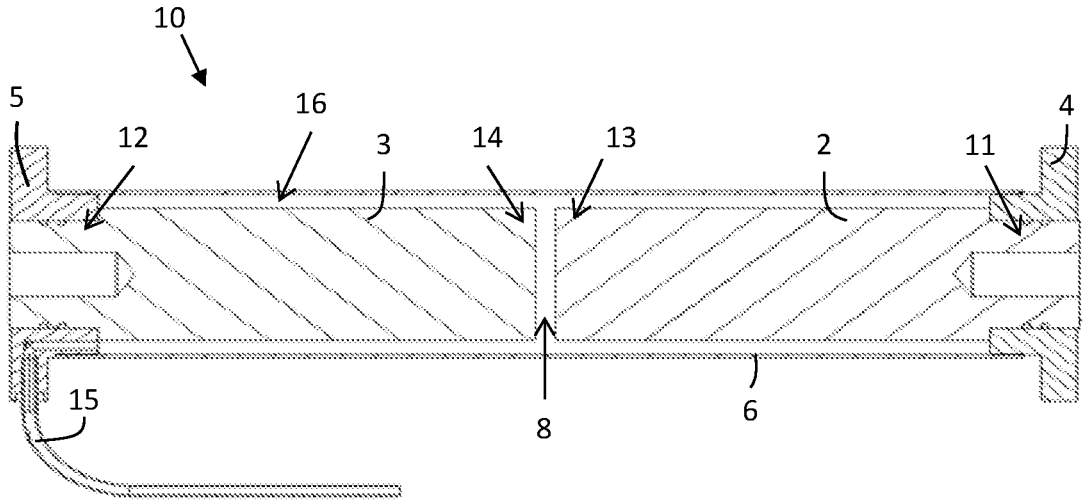
FIG. 3 is a sectional view of an embodiment of a gas gap heat switch.

In a further embodiment the conductors extend significantly beyond connecting members in a direction away from the gap, as per the FIG. 6 embodiment, however the sleeve is a separate part which is connected to the flanges at either end of the sleeve, as per the embodiment of FIGS. 1-3.

As will be appreciated a gas gap heat switch is therefore provided which is simpler and more robust than prior art interdigitated designs. The method of producing this heat switch has the further advantage that a smaller separation (of the order of tens of micrometres) between the facing ends of the thermal conductors can be achieved than has previously been possible (typically between 0.5-1.0 mm). Effective heat transfer can therefore be ensured whilst the switch is closed, without affecting the ability of the switch to thermally isolate bodies that are connected to the opposite ends of the switch, when the switch is open.

The invention claimed is:

1. A method for forming a gas gap heat switch comprising the following steps:

(a) providing first and second conductors, and first and second connecting members, wherein the first and second connecting members each have a thermal conductivity at least five times smaller than that of the first and second conductors when at a temperature of 100 K;

(b) fusing the first conductor to the first connecting member and the second conductor to the second connecting member;

(c) aligning the first and second conductors such that the first and second conductors extend along a common major axis;

(d) bringing proximal ends of the aligned first and second conductors into contact with each other when said first and second conductors are at a first temperature; and (e) joining the first connecting member to the second connecting member so as to form a chamber around at least the proximal ends of the first and second conductors;

wherein the first and second connecting members forming the chamber each have a coefficient of thermal expansion that is less than that of the first and second conductors such that, when the first and second conductors are cooled to a second temperature which is below the first temperature, a length of the first and second conductors along the major axis decreases with respect to a length of the chamber along the major axis so as to form a gap between the proximal ends of the first and second conductors; and wherein the switch is arranged to selectively provide a thermally conductive gas into the chamber when in use to cause operation of the switch.

2. The method of claim 1, wherein step (e) comprises fusing the first connecting member to the second connecting member.

3. The method of claim 2, wherein the first connecting member comprises a sleeve configured to envelope at least the proximal ends of the first and second conductors.

4. The method of claim 2, wherein fusing the first connecting member to the second connecting member is performed using electron-beam welding.

5. The method of claim 1, wherein step (e) comprises fusing each of the first and second connecting members to a sleeve provided between said first and second connecting members;

wherein the thermal conductivity of the sleeve is at least five times smaller than that of the first and second conductors when at a temperature of 100 K; and wherein the coefficient of thermal expansion of the sleeve is less than that of the first and second conductors such that, when the first and second conductors are cooled to the second temperature, the length of the first and second conductors along the major axis decreases so as to form said gap.

6. The method of claim 5, wherein the first and second connecting members are arranged as first and second flanges respectively.

7. The method of claim 5, wherein fusing each of the first and second connecting members to the sleeve is performed using electron-beam welding.

8. The method of claim 5, wherein the sleeve has a thermal conductivity at least 10 times smaller than that of the first and second conductors when at a temperature of 100 K.

9. The method of claim 1, further comprising the following step:

(f) cooling each of the first and second conductors to a respective temperature that is below the second temperature such that the length of the first and second conductors along the major axis decreases so as to form the gap between the proximal ends of the first and second conductors.

10. The method of claim 1, wherein step (a) further comprises machining the first and second conductors so as to form a flat engagement surface on each of the first and second conductors; and wherein step (d) comprises bringing said engagement surfaces into contact with each other.

11. The method of claim 10, wherein said engagement surfaces extend in a plane having a normal that extends along the major axis.

12. The method of claim 1, wherein the first and second conductors are elongate.

13. The method of any claim 1, wherein the gap is less than 0.05% the sum of the dimensions of the first and second conductors along the major axis between the respective points of joining of the first conductor with the first connecting member and the second conductor with the second connecting member.

14. The method of claim 1, wherein step (b) is performed by a brazing process.

15. The method of claim 1, wherein the first and second connecting members have a thermal conductivity at least 10 times smaller than that of the first and second conductors when at a temperature of 100 K.

16. The method of claim 1, wherein the switch is configured to evacuate the chamber when in use in order to substantially thermally isolate the opposing distal ends of the first and second conductors.

17. The method of claim 1, wherein the first temperature is between 280 to 310 K and wherein the second temperature is between 5 to 20 K.

18. A gas gap heat switch comprising:

a first conductor and a second conductor aligned along a common major axis, wherein the first conductor and the second conductor each have a length of at least 5 cm along the major axis; and a first connecting member and a second connecting member forming a chamber around at least proximal ends of the first conductor and the second conductor, wherein the first connecting member and the second connecting member have a thermal conductivity at least five times smaller than that of the first conductor and the second conductor when at a temperature of 100 K, wherein the first connecting member and the second connecting member each have a coefficient of thermal expansion that is less than that of the first conductor and the second conductor, wherein the proximal end of the first conductor is separated from the proximal end of a second conductor by a gap of less than 50 μm, and wherein a switch is arranged to selectively provide a thermally conductive gas into the chamber when in use to cause operation of the switch.

19. The gas gap heat switch according to claim 18, further comprising a sleeve provided between said connecting members and arranged to extend at least over the proximal ends of the first and second conductors, wherein each of the first and second connecting members is fused to the sleeve, wherein the sleeve has a thermal conductivity at least five times smaller than that of the first and second conductors when at a temperature of 100 K, wherein the sleeve has a coefficient of thermal expansion that is less than that of the first and second conductors, and wherein the sleeve and the first and second connecting members form the chamber.

20. A cryogenic system comprising: a gas gap heat switch comprising:

a first conductor and a second conductor aligned along a common major axis, wherein the first conductor and the second conductor each have a length of at least 5 cm along the major axis; and a first connecting member and a second connecting member forming a chamber around at least proximal ends of the first conductor and the second conductor, wherein the first connecting member and the second connecting member have a thermal conductivity at least five times smaller than that of the first conductor and the second conductor when at a temperature of 100 K, wherein the first connecting member and the second connecting member each have a coefficient of thermal expansion that is less than that of the first conductor and the second conductor, wherein the proximal end of the first conductor is separated from the proximal end of the second conductor by a gap of less than 50 μm, and wherein a switch is arranged to selectively provide a thermally conductive gas into the chamber when in use to cause operation of the switch;

a mechanical refrigerator coupled to the first conductor; and a target apparatus coupled to the second conductor.

* * * * *